US008153216B2

(12) United States Patent
Fenn-Barrabaβ et al.

(10) Patent No.: US 8,153,216 B2
(45) Date of Patent: Apr. 10, 2012

(54) PACKAGING WITH PASSAGE REGIONS AND SEALING TOOL FOR PRODUCTION THEREOF

(75) Inventors: Christian Fenn-Barrabaβ, Obergünzburg (DE); Gerhard Ricder, Ottobeuren (DE)

(73) Assignee: Huhtamaki Ronsberg, Zweigniederlassung der Huhtamaki Deutschland GmbH & Co. KG, Ronsberg (DE)

( * ) Notice: Subject to any disclaimer, the term of this patent is extended or adjusted under 35 U.S.C. 154(b) by 710 days.

(21) Appl. No.: 10/498,783

(22) PCT Filed: Dec. 13, 2002

(86) PCT No.: PCT/EP02/14242

§ 371 (c)(1),
(2), (4) Date: Jul. 25, 2005

(87) PCT Pub. No.: WO03/051745

PCT Pub. Date: Jun. 26, 2003

(65) Prior Publication Data

US 2008/0044525 A1 Feb. 21, 2008

(30) Foreign Application Priority Data

Dec. 14, 2001 (DE) ..... 201 20 253 U
Mar. 15, 2002 (DE) ..... 102 11 593

(51) Int. Cl.
*B32B 1/04* (2006.01)
*B65D 51/16* (2006.01)

(52) U.S. Cl. ..... 428/35.7; 220/359.1; 220/360; 220/363; 53/477

(58) Field of Classification Search ..... 428/35.7; 220/359.1, 360, 363; 53/477
See application file for complete search history.

(56) References Cited

U.S. PATENT DOCUMENTS

| | | | |
|---|---|---|---|
| 2,370,226 | A | 2/1945 | Brede |
| 2,626,647 | A | 1/1953 | Barton |
| 2,847,151 | A | 8/1958 | Meyer-Jagenberh |
| 3,128,913 | A | 4/1964 | Specketer |
| 3,217,951 | A | 11/1965 | Paal |
| 3,291,377 | A | 12/1966 | Eggen |
| 3,313,333 | A | 4/1967 | Lordi |
| 3,317,110 | A | 5/1967 | Palmer |

(Continued)

FOREIGN PATENT DOCUMENTS

CA 2342504 A1 10/2001

(Continued)

OTHER PUBLICATIONS

EPO machine translation of DE 19860473.*

(Continued)

*Primary Examiner* — Michele L Jacobson
(74) *Attorney, Agent, or Firm* — Knobbe Martens Olson & Bear LLP

(57) ABSTRACT

A packaging (1) for a material that can be heated, especially microwave-heated, in the packaged state, which packaging has at least one sealing region (5) which becomes locally permeable when a predetermined internal pressure is exceeded. The or each sealing region of such a kind has at least one intended passage region (7, 9), which comprises a choke (9) for the contents of the packaging and an apex (7) pointing towards the interior of the packaging. As the choke there is used a channel-like, triangular or star-shaped interrupt ion or cut-out.

7 Claims, 7 Drawing Sheets

U.S. PATENT DOCUMENTS 3,396,899 A 8/1968 Strouse et al.
D214,023 S 5/1969 Beaumont
3,519,158 A 7/1970 Anderson
3,604,491 A 9/1971 Spiess
3,608,709 A 9/1971 Pike et al.
3,690,524 A 9/1972 Haberhauer
3,832,964 A 9/1974 Rockefeller
3,935,993 A 2/1976 Doyen et al.
3,937,396 A 2/1976 Schneider
3,997,677 A * 12/1976 Hirsch et al. ..... 426/113
4,091,929 A 5/1978 Krane et al.
4,116,359 A 9/1978 Josephy
4,132,331 A 1/1979 Magerle
3,548,564 A 12/1979 Bruce et al.
4,210,674 A * 7/1980 Mitchell ..... 426/107
4,216,268 A 8/1980 Stillman
4,241,130 A 12/1980 Barnes
4,252,238 A 2/1981 Spiegelberg
4,262,819 A 4/1981 Hayes
4,337,862 A 7/1982 Suter et al.
4,353,497 A 10/1982 Bustin
4,428,477 A 1/1984 Cristofolo
4,471,882 A 9/1984 Joo
4,526,287 A 7/1985 Miyamatsu et al.
4,541,546 A 9/1985 Imazu et al.
4,568,001 A 2/1986 Sander
4,572,377 A 2/1986 Beckett
4,606,462 A 8/1986 Bogren et al.
4,659,408 A 4/1987 Redding
4,709,397 A 11/1987 Voshall et al.
4,775,098 A 10/1988 Peer, Jr.
4,779,998 A 10/1988 Wischusen, III
4,792,061 A 12/1988 Nishida
4,834,247 A * 5/1989 Oshima et al. ..... 426/107
4,890,744 A 1/1990 Lane, Jr. et al.
D311,488 S * 10/1990 Regenscheid ..... D9/707
4,978,015 A 12/1990 Walker
4,983,431 A 1/1991 Gibbons et al.
4,986,053 A 1/1991 Schaefer
4,997,661 A 3/1991 Kromer
5,009,364 A 4/1991 Bolte
5,024,044 A 6/1991 Friedrich et al.
5,041,180 A 8/1991 Makilaakso
5,098,794 A 3/1992 Schaefer
5,114,766 A * 5/1992 Jacques ..... 428/35.7
5,205,651 A 4/1993 Decottignies et al.
5,217,164 A 6/1993 Sullivan et al.
5,263,606 A 11/1993 Dutt et al.
5,284,540 A 2/1994 Roth et al.
5,350,240 A 9/1994 Billman et al.
5,409,115 A 4/1995 Barkhorn
5,460,838 A 10/1995 Wermund
5,493,844 A 2/1996 Combrink
5,587,192 A * 12/1996 Beizermann ..... 426/118
5,622,432 A 4/1997 Zicker
5,647,500 A 7/1997 Konno et al.
5,823,383 A 10/1998 Hins
5,885,673 A 3/1999 Light et al.
5,913,449 A 6/1999 Branch et al.
5,939,153 A 8/1999 Valyi
5,945,145 A 8/1999 Narsutis et al.
6,000,848 A 12/1999 Massioui
6,004,638 A 12/1999 Kaya et al.
6,050,451 A 4/2000 Hess, III et al.
6,076,664 A 6/2000 Yeager
6,123,211 A 9/2000 Rashid et al.
6,199,698 B1 3/2001 Hetrick et al.
6,220,310 B1 4/2001 Emmer
6,226,964 B1 5/2001 Vettorato
6,231,237 B1 5/2001 Geller
6,261,215 B1 7/2001 Imer
6,270,867 B1 8/2001 Eckstein et al.
6,276,546 B1 8/2001 Davis et al.
6,279,297 B1 8/2001 Latronico
6,287,658 B1 9/2001 Cosentino et al.
6,334,710 B1 1/2002 Kuge et al.
6,399,014 B1 6/2002 Hermodsson
6,436,497 B1 8/2002 Takahashi et al.
6,436,499 B1 8/2002 Krampe et al.
6,478,190 B2 11/2002 Kuge et al.
D476,565 S 7/2003 Rosen
6,783,277 B2 8/2004 Edwards et al.
6,929,400 B2 8/2005 Razeti et al.
6,938,805 B2 9/2005 Brincat
D510,277 S 10/2005 Bennie et al.
7,034,268 B2 * 4/2006 Hopkins, Sr. ..... 219/735
7,105,788 B2 * 9/2006 Hopkins ..... 219/725
7,115,309 B2 10/2006 Akiyama et al.
7,364,047 B2 4/2008 Michalsky
7,543,990 B2 6/2009 Michalsky
2001/0042757 A1 11/2001 Kuge et al.
2002/0112982 A1 8/2002 Stagray et al.
2002/0162863 A1 11/2002 Brincat
2002/0182351 A1 12/2002 Akiyama et al.
2003/0059130 A1 3/2003 Youneyama et al.
2003/0144122 A1 7/2003 Post et al.
2004/0052987 A1 3/2004 Shetty et al.
2004/0238475 A1 12/2004 Peronek
2005/0041888 A1 2/2005 Matsuzawa et al.
2006/0201903 A1 9/2006 Peronek
2008/0184548 A1 8/2008 Michalsky

FOREIGN PATENT DOCUMENTS

DE 33 29 533 A1 3/1985
DE 40 23 602 A1 1/1992
DE 198 60 473 A1 6/2000
DE 102 21 432 12/2003
DE 102 57 145 6/2004
EP 0 078 761 5/1983
EP 0 182 416 A 5/1986
EP 0 203 612 A2 5/1986
EP 0321172 A2 6/1989
EP 0 324 260 7/1989
EP 0 333 443 9/1989
EP 0 446 005 9/1991
EP 0 521 642 A 1/1993
EP 0595587 B1 5/1994
EP 0684184 11/1995
EP 0 772 522 5/1997
EP 0 785 148 A 7/1997
EP 0833774 B1 4/1998
EP 0 661 219 B1 3/2000
EP 1 029 794 A 8/2000
EP 1 086 906 A 3/2001
EP 1151934 11/2001
EP 1174360 1/2002
EP 0 976 539 2/2002
EP 1064150 B1 10/2002
EP 1 331 174 7/2003
EP 1 508 531 A 2/2005
EP 1512637 3/2005
EP 1621477 2/2006
FR 2 859 182 A 3/2005
GB 1 298 790 A 12/1972
GB 2 254 594 A 10/1992
GB 2257943 A 1/1993
GB 2 188 520 A 9/1997
JP 2000-006999 1/2000
JP 2000-211675 8/2000
JP 2001-080650 3/2001
JP 2000 335630 A 4/2001
JP 2002-104446 4/2002
WO WO 94/23945 10/1994
WO WO 96/03281 2/1996
WO WO 96/21599 A 7/1996
WO WO 98/02305 A1 1/1998
WO WO 99/46120 A1 9/1999
WO WO 99/64227 12/1999
WO WO 00/00396 1/2000
WO WO 0012387 3/2000
WO WO 00/49908 8/2000
WO WO 00/50314 8/2000
WO WO 01/83212 A 11/2001

| | | | |
|---|---|---|---|
| WO | WO 02/055402 | | 7/2002 |
| WO | WO 02/055405 | | 7/2002 |
| WO | WO 03/018420 | A | 3/2003 |
| WO | WO 03/097479 | | 11/2003 |
| WO | WO 2004/101374 | A | 11/2004 |
| WO | WO 2005/105600 | | 11/2005 |
| WO | WO 2006/000820 | | 1/2006 |
| WO | WO 2007/042174 | A1 | 4/2007 |

OTHER PUBLICATIONS

Chinese Office Action dated Aug. 24, 2007.
European Examination Report dated Apr. 25, 2005.
Allcock, Harry R., "Contemporary Polymer Chemistry"—1990, Prentice Hall, second edition, p. 34, 1990.

* cited by examiner

PACKAGING WITH PASSAGE REGIONS AND SEALING TOOL FOR PRODUCTION THEREOF

The invention relates to a packaging according to the preamble of claim 1 and also to a sealing tool for the production thereof.

Packagings for goods—especially food—to be heated inside the packaging are known. In particular, the mass spread of microwave devices has resulted in virtually anyone being able to prepare for themselves hot snacks or proper hot meals or even popcorn or the like directly in the packaging, without having to use (and afterwards wash) cooking vessels or other containers for the purpose.

The problem is also known that such packagings have a tendency to burst (so-called "exploding") because of the heating and associated expansion of the contents, which is not only an annoyance but can also be dangerous. In certain applications, and up to a certain extent, it is possible to deal with that problem by over-dimensioning the packaging. However, such over-dimensioning naturally has considerable disadvantages, inter alia a greater use of packaging materials and of transportation and storage space. Attempts have therefore already been made at finding special packaging arrangements by means of which it is possible to deal with the problem of the packaging exploding in uncontrolled manner when the contents are heated.

Such a packaging arrangement is described in EP 0 661 219 B1. By means of a multi-part arrangement, which includes a film provided with cuts and a layer associated therewith made from a pressure-sensitive adhesive agent, it is possible, in the case of such an arrangement, on the one hand, for a certain positive pressure to be built up (bringing out about a reduction in the cooking time) and, on the other hand, for an inadmissibly high positive pressure to escape in controlled manner. The complicated multi-layer arrangement is, however, relatively costly to produce and also results in limitation of the possible uses.

The invention is accordingly based on the problem of providing a simple and economically produced packaging of the generic kind wherein no uncontrolled explosion can occur when the contents are heated.

The problem is solved by a packaging having the features of claim 1. There is furthermore proposed a sealing tool by means of which such a packaging can be produced in simple manner.

The invention includes the basic idea of retaining the principle, which has proven itself in mass-production and is extremely economical, of the packaging closure being in the form of a simple sealed seam and of allowing positive pressure inside the packaging to escape through that sealed seam in controlled manner. The invention furthermore includes the idea of providing, within the sealed seam, regions through which the positive pressure can escape locally. Those regions are also referred to hereinbelow as desired passage regions.

Finally, the invention includes the idea of forming those desired passage regions with a contour which includes an apex. A positive pressure which builds up in the packaging on heating has an especially effective action at such an apex, where it brings about local separation of the sealing, while the sealed seam in the regions away from the apex remains tightly sealed. In a certain sense the invention accordingly utilises, in inverse manner, the principle—used in the case of tools of many kinds—of maximising the surface pressure.

In an embodiment to which special preference is given because of its widespread use in practice, the packaging is a tubular bag having two sealing regions located opposite one another, each of which has at least one intended passage region formed with an apex, especially two to four intended passage regions of such a kind. In particular, such a tubular bag can be formed in especially simple manner by the sealing tool which is likewise proposed. It is also possible for only one of the sealing regions to be formed in that manner. The invention is, however, equally well suited to stand-up bags, wherein, for example, only the upper closure seam or top sealed seam is formed in accordance with the invention.

There is preferably arranged, behind the or each apex, a channel-like interruption in the course of the sealed seam, at the outer edge of the packaging. A gas present in the packaging under an inadmissibly high positive pressure can then escape into the atmosphere in controlled manner through that channel or gap in the "regular" course of the sealed seam. The dimensioning of the gap or channel depends upon the material to be packaged and must of course ensure that no liquid or finely particulate packaging contents (or at most only a small amount thereof) pass through to the outside. In the case of relatively coarse packaging contents (for example, pulses, popcorn or the like), the channel can therefore be wider than in the case of finely particulate material. The said channel consequently functions as a choke for the packaging contents.

In especially advantageous manner, the sealing region is formed using a sealing film of reduced sealed seam strength. Such sealing films have been in use for a long time and will be familiar to the person skilled in the art; they allow especially good control of the tearing open of the packaging in the intended passage regions.

As regards the form of the apex and, in general, of the sealed seam which opens locally in controlled manner there are no particular limitations, provided that regions are nevertheless present wherein the effect of the force of the internal pressure in the packaging is substantially greater than in the rest of the course of the sealed seam. There may accordingly be provided apexes that are formed by two straight sealed seam edges meeting one another at an acute angle or by curved sealed seam edges converging towards one another. The increased tear-open forces which are essential in the context of the invention occur even at "apexes" that are rounded off with a small radius of curvature.

In the apex region, the width of the sealed seam provided with the contour according to the invention is, especially, smaller compared to the rest of its course. As a result, the adhesive force of the PEEL sealing film in those regions is brought to a precise, pre-adjustable value. Accordingly, taking into account the specific contour of the intended passage region, it is possible for exactly controlled local opening of the sealed seam to be achieved when a predetermined internal pressure is reached in the packaging.

In accordance with one embodiment, the interruption serving as the choke is an especially triangular, round or star-shaped cut-out.

The cut-out is provided at least in a lidding film, there being associated with a sealing region—especially a triangular or star-shaped sealing region—surrounding the cut-out a sealing region which is raised with respect to a film located on the other side of the cut-out or pierced film or with respect to an associated tray base. In that embodiment it is advantageous that a film, especially a lidding film, can be so applied to a tubular bag packaging or a tray container that a cut-out in that lidding film, which may also be a tubular bag side wall film advantageously located at the top, can be arranged on a dividing wall sub-dividing the packaging into a plurality of sub-regions and sealed there—at its surrounding region—to the lidding film. In the event of positive pressure occurring, the seal surrounding the cut-out, that is to say the especially triangular or star-shaped sealing region, would accordingly be peeled open so that a positive pressure brought about in the packaging can escape through the cut-out provided at least in the lidding film. In accordance with the invention there is also provided a cut-out in the raised sealing region, that is to say, for example, in a dividing wall sub-dividing the packaging into different individual regions, provided that this is allowed by the contents of the packaging. Of course, if several dividing walls are present, there may also be several cut-outs both in the lidding film and also in the associated dividing wall sealing region.

There is likewise provided in accordance with the invention, in the case of a packaging in the form of a container tray, a raised sealing region in the form of a hollow column which is open to the outside and which rises up from the tray base, the triangular or star-shaped sealing region which surrounds the cut-out being sealed to the hollow column. Of course, the hollow column can also have a triangular, round or star-shaped cut-out so that a positive pressure can also escape to the outside through the hollow column as soon as the seal provided with an apex has been broken.

From a process point of view, the cut-out can be made by piercing the lidding film with a spike when it is being applied to the hollow column or dividing wall. Sealing of the lidding film takes place around the spike, ensuring that the interior of the container is sealed off.

In accordance with a further embodiment of the invention, the cut-out is provided in a sealing region adjacent to the tray side wall. This especially simple embodiment is extremely advantageous when the packaging has only one internal volume which is not separated from a further internal volume of the packaging by a dividing seal. The cut-out can accordingly be arranged in a rim of the tray container.

In accordance with the invention, the cut-out projects, by at least one apex of a triangle or star, beyond a notional line formed by connecting, in a straight line, the inner boundaries, adjacent to the apex projecting into the interior of the packaging, of the sealing region closing off the packaging, that is to say of the main sealed seam. This embodiment ensures that a positive pressure can escape through the cut-out in all cases, that is to say even in the case of very strong sealing in the main sealing region, which ensures reliable sealing-off of the packaging. The cut-out, as already described hereinbefore, can be provided at least in a lidding film. It can, however, also be cut out through the lidding film and the film adjacent thereto or the tray region adjacent thereto. It is possible to adjust or predetermine the extent to which a positive pressure can escape from the packaging by means of the number and size of the cut-outs.

In accordance with a further embodiment of the invention, the apex projecting into the interior of the packaging, including the associated channel-like interruption and/or cut-out, is arranged at least partly in the sealing region to the outside of the notional line, with regions of the sealing region that are located to the side of the apex and that are in communication with the interior of the packaging being unsealed.

In especially advantageous manner, it is possible by means of that embodiment to use a tray container having a conventional sealing rim. In that case, sealing of the lidding film is so performed that, in the region of the apex, only part of the sealing rim of the tray container is actually sealed to the lidding film. Of course, sealing is ensured in an outer region of the sealing rim so that the sealing-off of the packaging is ensured in all cases provided that positive pressure does not come about in the packaging.

In accordance with a further embodiment of the invention, the interruption serving as the choke, especially a channel-like interruption and/or cut-out, widens out in the direction of the outer edge of the packaging. By that means it is ensured that gas or steam, which has resulted in peeling of the apex-shaped sealing region because of the occurrence of positive pressure, itself undergoes pressure-reduction as it emerges. The jet-like emergence of hot gas or steam is consequently avoided because the steam can undergo pressure-reduction in a region of widening in the interruption.

The features of the proposed sealing tool are largely derived from the packaging features described hereinbefore. In a preferred embodiment, the basic body is of substantially parallelepipedal shape having behind the or each apex an interruption bridged by the apex and a width in the plane of action which is greater than the wall width of the apex.

Advantages and useful features of the invention will be found from the subordinate claims and from the following description of a preferred exemplary embodiment referring to the Figures, wherein:

Figure 1:
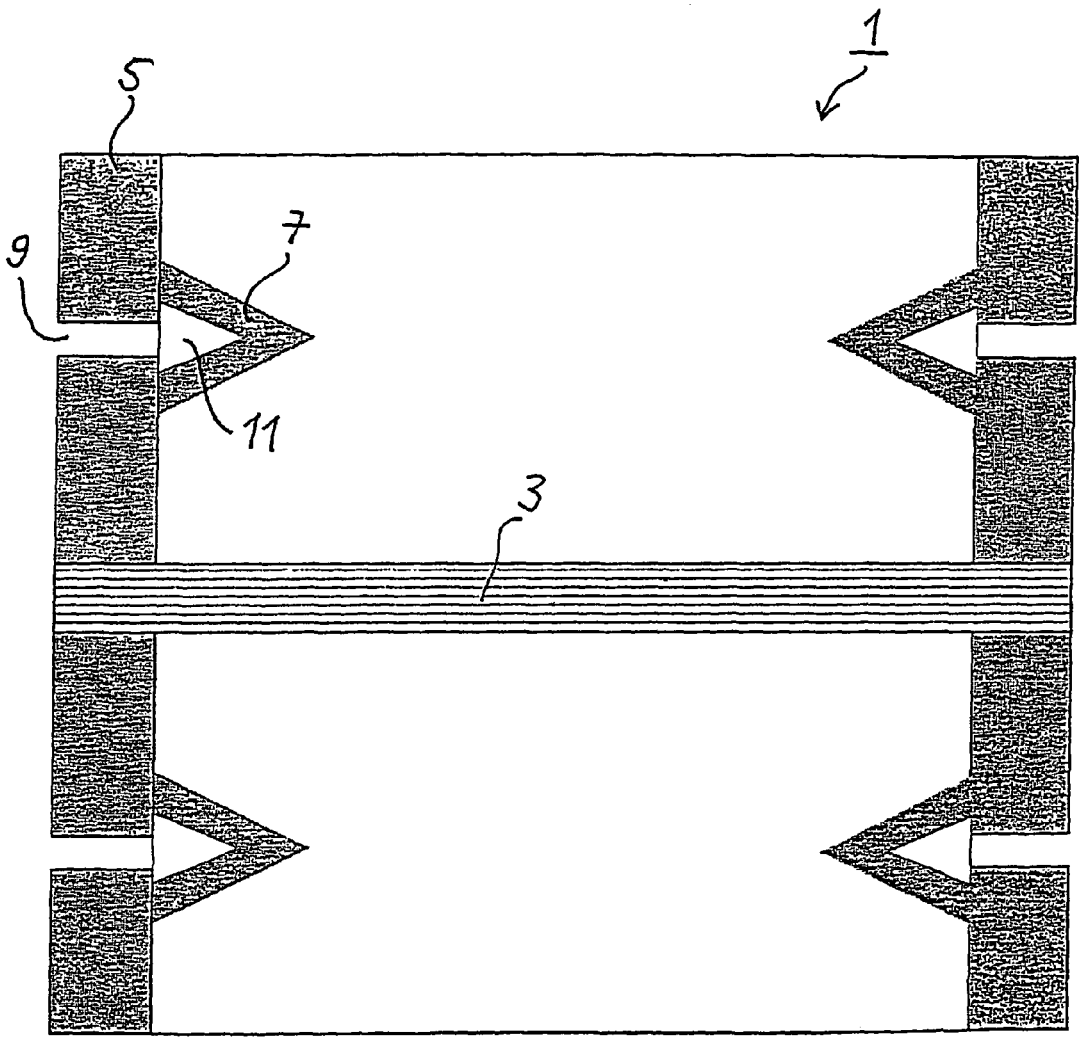
FIG. 1 is a diagrammatic top-view of a tubular bag having crosswise sealing in accordance with the invention.

FIG. 1 is a diagrammatic view of a tubular bag 1 in which there is packed, for example, food that can be heated in a microwave and that has a non-liquid consistency (pulses, popcorn etc.). The tubular bag 1 is formed by putting together, to form a ring, and longitudinally sealing, a packaging film conventionally used for that purpose, having a longitudinal sealed seam 3 and two crosswise sealed seams 5 located opposite one another and oriented substantially parallel to one another. The crosswise sealed seams 5 are formed using so-called PEEL films of reduced sealed seam strength. Such PEEL films are also known per se and therefore do not need to described in greater detail.

The crosswise sealed seams 5 have a mutually congruent shape, in each case two sealed seam apexes 7 extending out from the substantially rectilinear course of the sealed seam, in the direction of the interior of the tubular bag 1. In the region of the apexes, the width of the sealing region (the sealed seam) is much less than in its rectilinearly oriented regions (for example, approximately 30% of the width thereof).

The included angle between the two edges forming the apex 7 is approximately 50°, but the invention can also be carried out using other angles. Moreover, alternatively, the apex could be also be formed by the convergence of two curved sealed seam regions and even slightly rounded off (with a very small diameter). It is likewise not necessary for the apex to project from an otherwise rectilinearly oriented sealed seam but rather the rest of the course of the sealed seam can also be curved or otherwise irregular.

In the rectilinear course of the crosswise sealed seams 5 there is formed, in alignment with each of the apexes 7, a gap 9 in the sealed seam which functions as a channel between the interior of the bag and the atmosphere, which channel is closed off by the apex 7 when the tubular bag 1 is in its delivery state. When, as a result of heating the contents of the tubular bag 1, a positive pressure exceeding a certain magnitude is built up, that pressure firstly causes the film surfaces sealed to one another at the outermost sealed seam apex 7 to come apart, that is to say causes the crosswise sealed seam to tear open. The gas under positive pressure in the interior of the tubular bag then enters the apex undercut region 11 and from there emerges into the atmosphere through the channel 9 in desirable manner, as a result of which uncontrolled bursting ("exploding") of the tubular bag is prevented.

Figure 2:
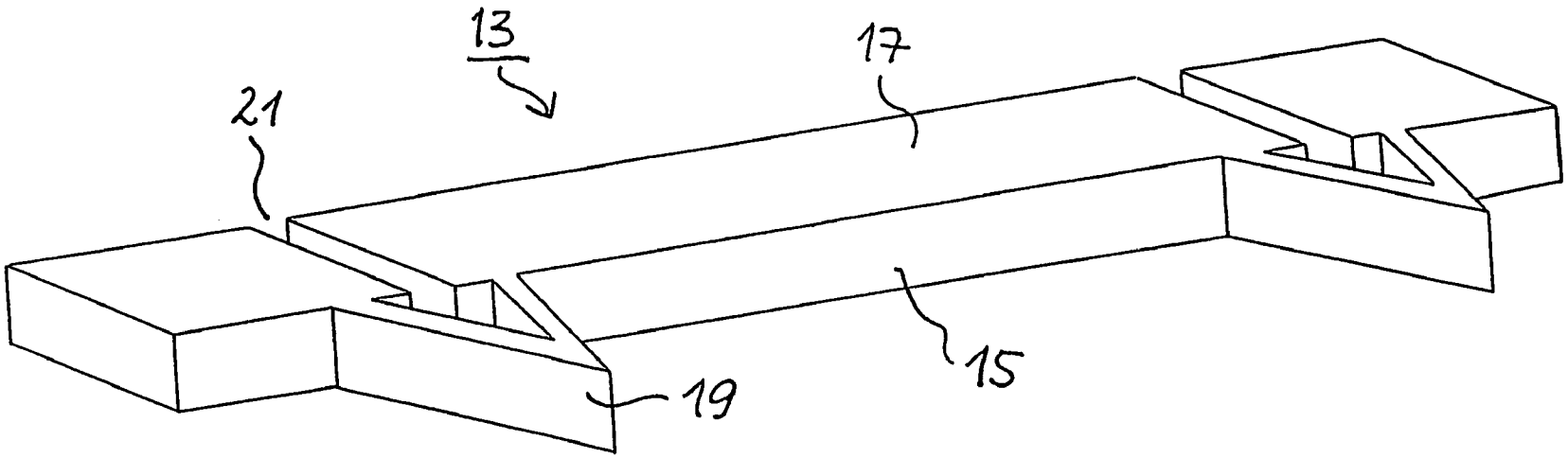
FIG. 2 is a perspective view of a sealing tool for producing the tubular bag according to FIG. 1.

FIG. 2 shows a sealing tool 13 for producing the tubular bag according to FIG. 1. The tool has a substantially parallelepipedal basic body 15, in which there are provided, close to the ends, two gaps 21 in the basic body, each of which is bridged by a tool apex 19. The tool apexes 19 on the one hand ensure the mechanical integrity of the sealing tool as a whole and on the other hand serve as a forming means for the sealed seam apexes 7 of the crosswise sealed seams 5 of the tubular bag 1 (FIG. 1).

In a manner known per se, the sealing tool 13 is pressed onto the placed-together layers of the bag film and joins them to one another along its active surface 17. Because the upper surfaces of the tool apexes 19 lie in the same plane as the active surface 17 of the basic body 15, they act fully as part of the active surface and produce the sealed seam apexes and their undercuts, and the presence of the gaps 21 in the basic body results in the formation of the gaps (channels) in the sealed seam of the tubular bag.

Figure 3:
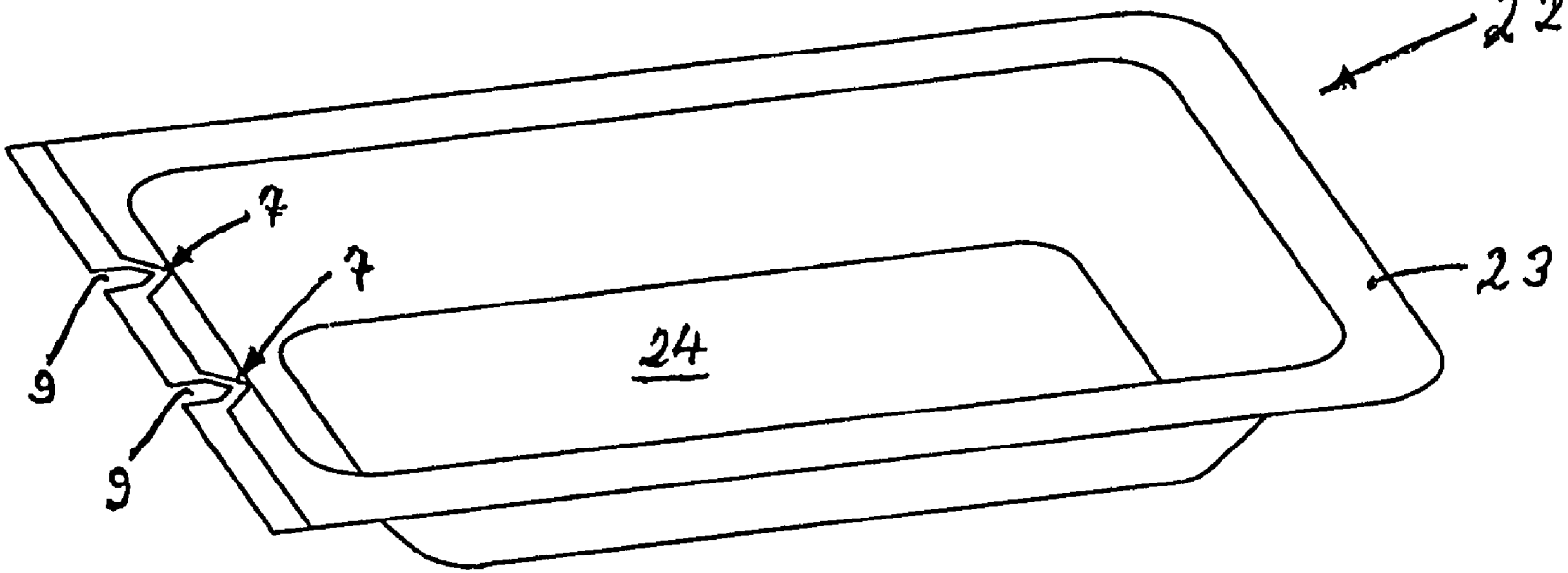
FIGS. 3-5 show three different embodiments of a tray packaging having a sealing rim formed in accordance with the invention, in each case in perspective view at an angle from above.
Figure 4:
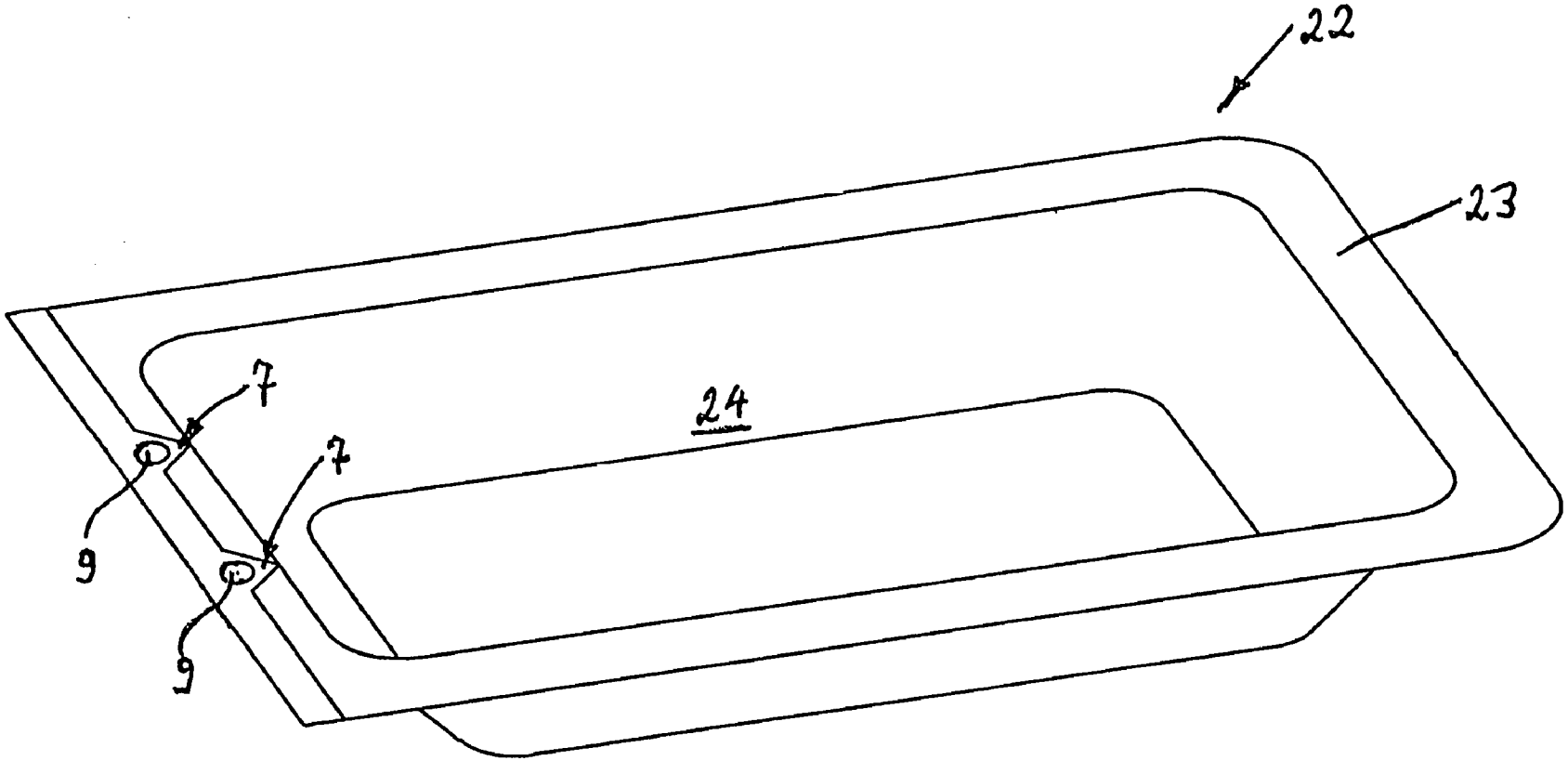
Figure 5:
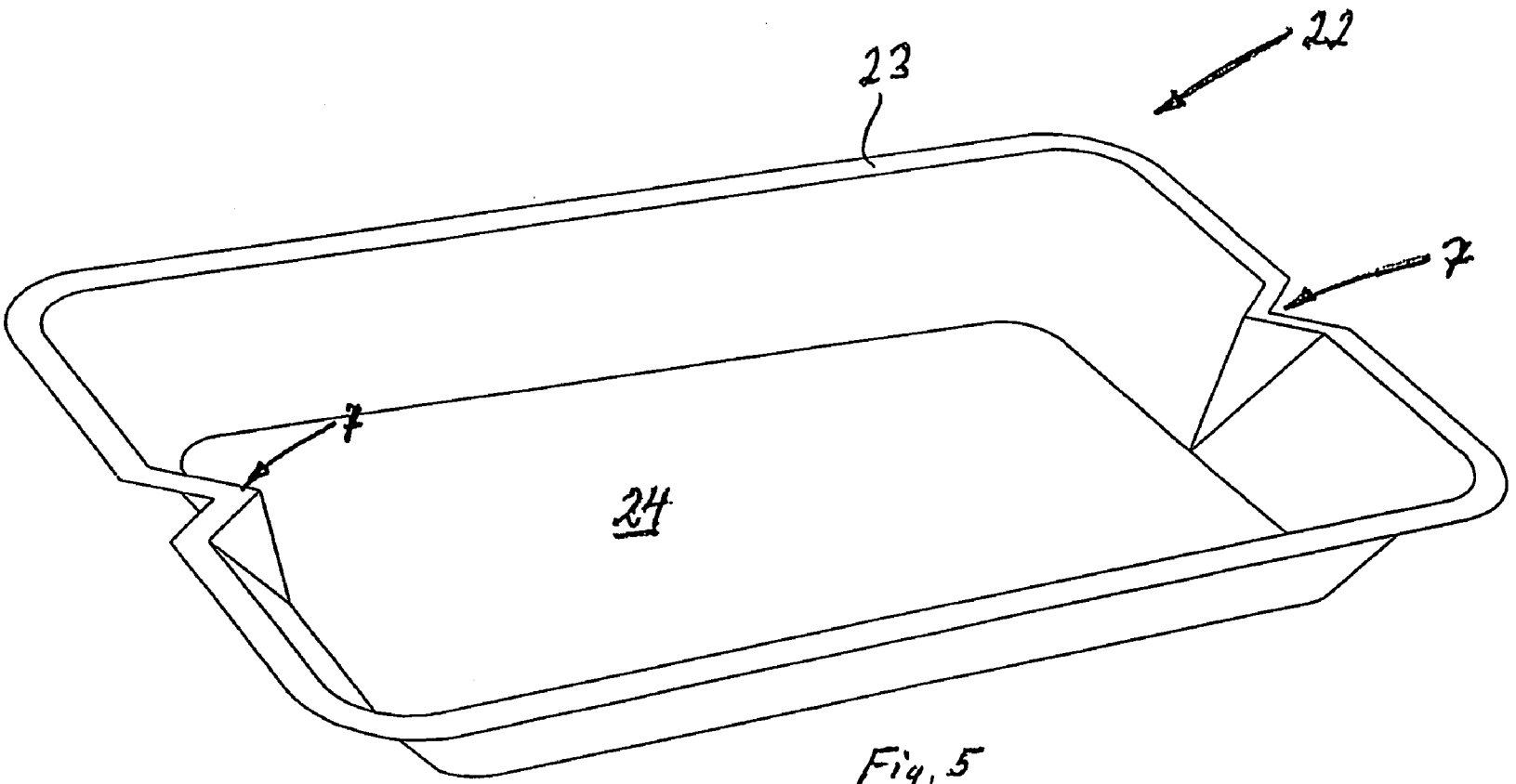

FIGS. 3 to 5 show three different embodiments of a tray packaging, in each case in perspective view at an angle from above. The first embodiment comprises a base tray 22 made from plastics material and produced, for example, by deep-drawing a plastics film. The tray has a surrounding sealing rim 23 onto which a sealing film can be sealed to close off the interior 24 of the packaging. At one end face, the sealing rim 23 has two apexes 7 spaced apart from one another and each facing the packaging interior 24, to the front of each of which there is arranged a channel 9 serving as a choke for the contents of the packaging. The channel 9 is, in each case, obtained by means of a cut-out in the sealing rim 23. That cut-out can be obtained before, after or while the sealing film is being sealed in place. The sealing film preferably extends over the entire sealing rim 23, up to the outermost edges thereof. In the case of this embodiment, the corresponding sealing tool can be formed in very simple and customary manner, for example as a rectangular frame having a planar sealing surface. In particular, it is not necessary for the sealing tool to be provided with apexes in accordance with the embodiment according to FIG. 2.

In the embodiment according to FIG. 4, the passages 9 arranged in front of the apexes 7 are in the form of approximately circular cut-outs, through which the steam that is formed on heating of the contents of the packaging can escape to the outside. The cut-outs 9 are of course so dimensioned that any emerging packaging contents are retained. To that extent the circular cut-outs 9 likewise constitute chokes for the packaging contents. In other respects the embodiment according to FIG. 4 corresponds to that according to FIG. 3.

In the embodiment according to FIG. 5, the sealing rim 23 and its inwardly projecting apexes 7 are predetermined by appropriate formation of the side walls of the base tray 22. In this case too, a channel corresponding to channel 9 according to FIG. 1 can also, preferably, be arranged in front of the apexes 7. That channel can, in FIG. 5, likewise be obtained by appropriate formation of the end-face side walls of the base tray 2.

Figure 6:
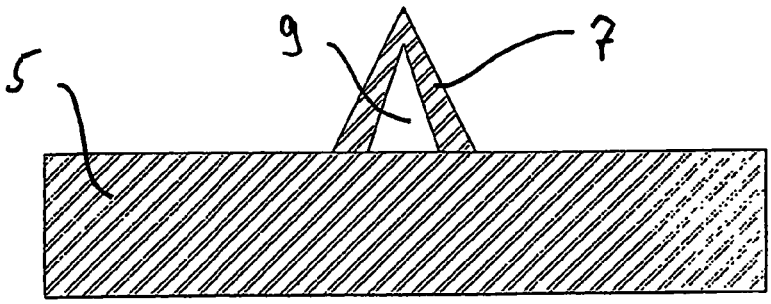
FIGS. 6-10 show five different embodiments relating to a possible arrangement of a triangular or star-shaped seal together with a corresponding cut-out in at least one lidding film and/or associated container.

FIG. 6 shows a crosswise or main sealed seam 5 having a sealed seam apex 7 arranged thereon. The sealing region of the sealed seam apex 7 surrounds a gap 9 in the sealed seam. The gap 9 in the sealed seam is in the form of a cut-out. The sealed seam apex 7, including the cut-out 9, is so arranged that, in the event of positive pressure escaping, no weakening of the main sealed seam 5 occurs. It is possible, using an appropriate closure, to re-close the opening then present as a result of the cut-out 9, if so desired.

Figure 7:
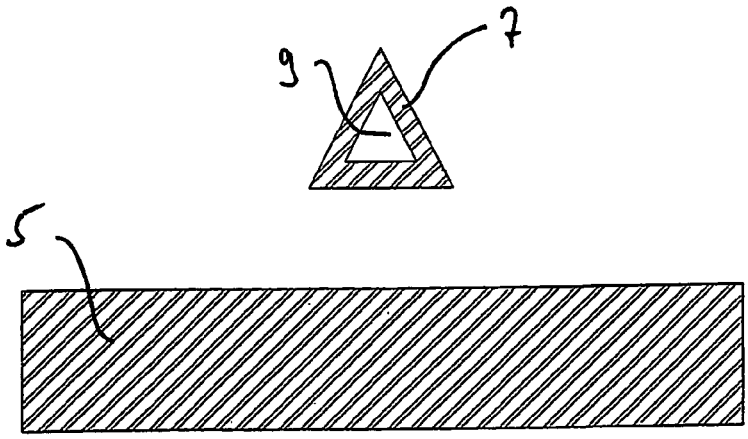
Figure 8:
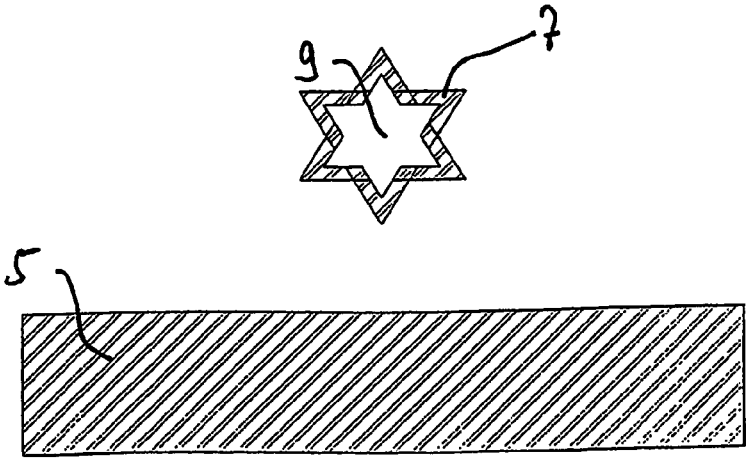

FIGS. 7 and 8 show a main sealed seam 5, spaced away from which there is provided a sealed seam apex in the form of a triangle (FIG. 7) and a star-shaped sealed seam apex (FIG. 8). The sealing regions 7 in question are provided spaced away from the main sealed seam 5. Those sealing regions 7 are, in accordance with the embodiment shown, sealed to a dividing wall, which divides the packaging into different compartments. In accordance with the invention, at least one apex of the sealing region 7 projects into each of the adjacent partial spaces of the packaging so that peeling open of the sealing 7 can start from each of the individual partial regions separately and independently of one another. It is consequently possible for a partial space having contents generating a large amount of steam or gas, for example contents having a high water content, which produces steam on heating, to peel open whereas another partial space, for example containing a dried material, continues to remain tightly sealed.

In accordance with one embodiment, a sealing region 7 spaced away from the main sealing region 5 can also be arranged on a hollow column. In that case the hollow column likewise has a cut-out 9, preferably of the relevant shape as also provided in the lidding film.

Figure 9:
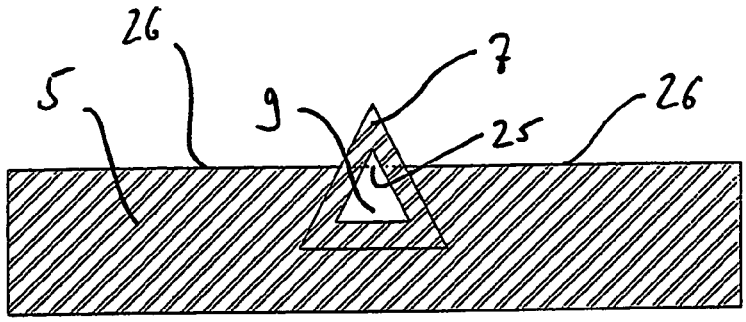

FIG. 9 shows an embodiment of the invention in which the sealed seam apex 7 is partially recessed in the main sealing region 5. In that embodiment it is essential that at least one apex of the cut-out 9 projects into the packaging interior. In accordance with the embodiment, the cut-out 9 therein extends beyond a notional line 25 formed by connecting, in a straight line, the inner boundaries 26, adjacent to the apex 7 projecting into the interior of the packaging, of the sealing region or main sealing region 5 closing the packaging.

Figure 10:
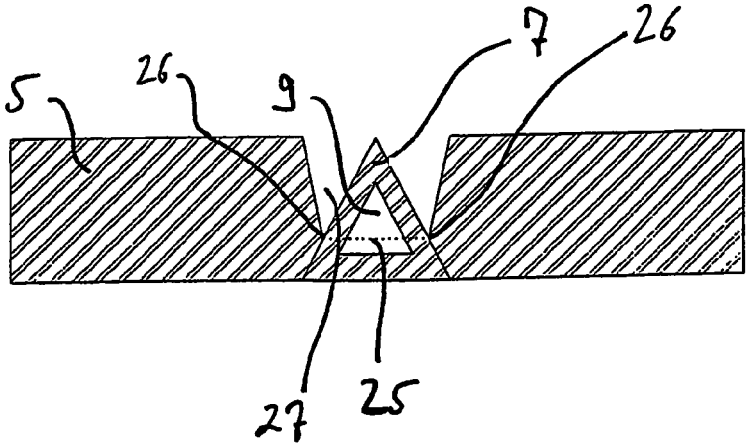

FIG. 10 shows an embodiment, similar to that shown in FIG. 9, wherein an indentation 27 is provided in the main sealing region 5, into which the sealed seam apex 7 has been recessed. The cut-out 9 again projects into the interior of the packaging beyond the notional line 25. It is essential to that embodiment that unsealed regions are provided to the side of the apex 7 inside the indentation 27 and adjacent to the main sealing region 5, which unsealed regions are in communication with the interior of the packaging. In that manner, a positive pressure that comes about in the packaging can act unhindered on the sealed apex 7 and peel it open by the application of pressure to an extent such that a positive pressure can escape through the cut-out 9.

Finally, it should be mentioned that it can be advantageous for the two legs of the intended passage region defining the apex to be so angled off on the inside or outside that the width of the sealing in the foremost apex itself, that is to say in the longitudinal direction of the apex, also corresponds approximately to that in the rest of the region thereof. As a result it is ensured in all cases that the apex will be the first to open under pressure. Defined self-opening of the packaging is obtained.

Carrying out the invention is not limited to this example but is also possible in a multiplicity of variants lying within the activity of the skilled person. In particular, the invention can be carried out using other tool shapes matched to desired forms of sealed seams and also in the case of packagings of other types in which the problems solved by the invention may occur.

LIST OF REFERENCE NUMERALS

1 tubular bag
3 longitudinal sealed seam

5 crosswise sealed seam
7 sealed seam apex
9 sealed seam gap (channel)
11 apex undercut region
13 sealing tool
15 basic body
17 active surface
19 tool apex
21 basic body gap
22 (base) tray
23 sealing rim
24 packaging interior
25 notional line
26 adjacent inner boundary
27 indentation

The invention claimed is:

1. A packaging for a material that can be heated in the packaged state, the packaging comprising a sealed seam extending generally along at least a portion of the packaging and a first sealing region which becomes locally permeable when a predetermined internal pressure is exceeded, the first sealing region comprising an apex pointing longitudinally towards the interior of the packaging and a cut-out, the apex being defined by two legs of the first sealing region that extend longitudinally towards the interior of the packaging and toward each other to meet in a peak at a foremost sealing region, the cut-out being bounded by at least the two legs of the apex and the sealed seam, the sealed seam comprising an inner boundary adjacent an interior of the packaging, the inner boundary being shaped so as to form an unsealed indentation in the sealed seam, wherein the apex is disposed at least partially within the indentation.

2. A packaging according to claim 1, comprising a lidding film, wherein the cut-out is provided at least in the lidding film, the first sealing region surrounding the cut-out being raised with respect to a film located on a side of the first sealing region opposite the side having the lidding film or with respect to a tray base associated with the lidding film and first sealing region.

3. A packaging according to claim 1, comprising a tray associated with the sealed seam and first sealing region, the tray having a plurality of sidewalls, wherein the first sealing region borders at least one of the side walls of the associated tray.

4. A packaging according to claim 1 comprising a tray, in which the first sealing region is formed in a sealing rim of the tray, and wherein the cut-out is located outside the side wall of the tray.

5. A packaging according to claim 1, wherein the cut-out is substantially triangular, round, or star-shaped.

6. A packaging according to claim 1, wherein an innermost portion of the inner boundary of the sealed seam is disposed at least as near to the interior of the packaging as the peak of the apex.

7. A packaging according to claim 1, wherein unsealed regions located to either side of the apex have a triangular shape.

* * * * *